US008245781B2

(12) United States Patent
Ciglenec et al.

(10) Patent No.: US 8,245,781 B2
(45) Date of Patent: Aug. 21, 2012

(54) FORMATION FLUID SAMPLING

(75) Inventors: Reinhart Ciglenec, Katy, TX (US); Steven G. Villareal, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 209 days.

(21) Appl. No.: 12/636,230

(22) Filed: Dec. 11, 2009

(65) Prior Publication Data

US 2011/0139448 A1 Jun. 16, 2011

(51) Int. Cl.
*E21B 49/10* (2006.01)

(52) U.S. Cl. ..... 166/264; 166/305.1

(58) Field of Classification Search ..... 166/264, 166/305.1, 307, 100; 175/50, 59
See application file for complete search history.

(56) References Cited

U.S. PATENT DOCUMENTS

| | | | | |
|---|---|---|---|---|
| 2,640,542 | A * | 6/1953 | Brown et al. | 166/66.4 |
| 3,318,393 | A * | 5/1967 | Brown | 175/4.52 |
| 3,934,468 | A | 1/1976 | Brieger | |
| 4,339,948 | A * | 7/1982 | Hallmark | 73/152.26 |
| 4,860,581 | A | 8/1989 | Zimmerman | |
| 4,893,505 | A | 1/1990 | Marsden et al. | |
| 4,936,139 | A | 6/1990 | Zimmerman et al. | |
| 5,113,953 | A | 5/1992 | Noble | |
| 5,265,682 | A | 11/1993 | Russell et al. | |
| 5,305,775 | A | 4/1994 | Farwell | |
| 5,520,255 | A | 5/1996 | Barr et al. | |
| 5,553,678 | A | 9/1996 | Barr et al. | |
| 5,553,679 | A | 9/1996 | Thorp | |
| 5,582,259 | A | 12/1996 | Barr | |
| 5,622,223 | A | 4/1997 | Vasquez | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |
| 5,778,992 | A | 7/1998 | Fuller | |
| 5,803,185 | A | 9/1998 | Barr et al. | |
| 5,971,085 | A | 10/1999 | Colebrook | |
| 6,089,332 | A | 7/2000 | Barr et al. | |
| 6,092,610 | A | 7/2000 | Kosmala et al. | |
| 6,092,666 | A | 7/2000 | Clark et al. | |
| 6,158,529 | A | 12/2000 | Dorel | |
| 6,244,361 | B1 | 6/2001 | Comeau | |
| 6,364,034 | B1 | 4/2002 | Schoeffler | |
| 6,380,599 | B1 | 4/2002 | Fazan | |
| 6,394,193 | B1 | 5/2002 | Askew | |
| 6,401,842 | B2 | 6/2002 | Webb et al. | |
| 6,467,544 | B1 * | 10/2002 | Brown et al. | 166/264 |
| 6,688,390 | B2 * | 2/2004 | Bolze et al. | 166/264 |
| 6,719,049 | B2 | 4/2004 | Sherwood et al. | |
| 7,302,966 | B2 | 12/2007 | Brennan, III et al. | |
| 7,527,070 | B2 | 5/2009 | Brennan, III et al. | |
| 2003/0134426 | A1 * | 7/2003 | Jiang et al. | 436/121 |
| 2004/0216874 | A1 * | 11/2004 | Grant et al. | 166/264 |
| 2006/0054323 | A1 * | 3/2006 | Grant et al. | 166/305.1 |
| 2006/0099093 | A1 | 5/2006 | Brennan III et al. | |
| 2007/0137896 | A1 * | 6/2007 | Villareal et al. | 175/59 |
| 2008/0156486 | A1 | 7/2008 | Ciglenec et al. | |
| 2009/0044951 | A1 | 2/2009 | Milkovisch et al. | |
| 2009/0195250 | A1 | 8/2009 | Welshans | |
| 2009/0255671 | A1 * | 10/2009 | Georgi et al. | 166/264 |

* cited by examiner

*Primary Examiner* — Brad Harcourt
*Assistant Examiner* — Blake Michener
(74) *Attorney, Agent, or Firm* — Brigitte Echols; Michael L. Flynn; Cathy Hewitt

(57) ABSTRACT

Formation testing via performing a first pumpout process to draw formation fluid at a wellbore position into the formation tester, discharging a treatment fluid from the formation tester into the formation at the same position, and drawing another formation fluid sample from the formation at the same position into the formation tester.

19 Claims, 4 Drawing Sheets

FORMATION FLUID SAMPLING

BACKGROUND

This section of this document is intended to introduce various aspects of the art that may be related to various aspects of the present disclosure described and/or claimed below. This section provides background information to facilitate a better understanding of the various aspects of the present invention. That such art is related in no way implies that it is prior art. The related art may or may not be prior art. It should therefore be understood that the statements in this section of this document are to be read in this light, and not as admissions of prior art.

Wells are generally drilled into the ground or ocean bed to recover natural deposits of oil and gas, as well as other desirable materials that are trapped in geological formations in the Earth's crust. A well is typically drilled using a drill bit attached to the lower end of a "drill string." Drilling fluid, or "mud," is typically pumped down through the drill string to the drill bit. The drilling fluid lubricates and cools the drill bit, and it carries drill cuttings back to the surface via the annulus between the drill string and the wellbore wall.

For successful oil and gas exploration, it may be useful to have information about the subsurface formations that are penetrated by a wellbore. For example, one aspect of standard formation evaluation relates to the measurements of the reservoir fluid pressure and/or formation permeability, among other reservoir properties. These measurements may be used to predict the production capacity and/or production life of a subsurface formation.

One technique for measuring reservoir properties includes lowering a "wireline" tool into the well to measure formation properties. A wireline tool is a measurement tool (e.g., logging tool) that is suspended from a wireline in electrical communication with a control system disposed on the surface. The tool is lowered into a well so that it can measure formation properties at desired depths. A typical wireline tool may include a probe or other sealing device, such as a pair of packers that may be pressed against the wellbore wall to establish fluid communication with the formation. This type of tool is often called a "formation tester." Using the probe, a formation tester measures the pressure of the formation fluids, generates a pressure pulse, which is used to determine the formation permeability. The formation tester tool also typically withdraws a sample of the formation fluid that may be stored in a sample chamber and subsequently transported to the surface for analysis and/or analyzed downhole. Some formation testers use a pump to actively draw the fluid sample out of the formation so that it may be stored in a sample chamber for later analysis. Such a pump may be powered by a generator in the drill string that is driven by the mud flow down the drill string. Examples of formation testers are described, for example, in U.S. Pat. App. Pub. Nos. 2008/0156486 and 2009/0195250.

In order to use any wireline tool, whether the tool be a resistivity, porosity or a formation testing tool, the drill string is usually removed from the well so that the tool can be lowered into the well. This is called a "trip" uphole. Then, the wireline tools may be lowered to the zone of interest. A combination of removing the drill string and lowering the wireline tools downhole are time-consuming measures and can take up to several hours, depending upon the depth of the wellbore. Because of the great expense and rig time required to "trip" the drill pipe and lower the wireline tools down the wellbore, wireline tools are generally used only when additional information about the reservoir is beneficial and/or when the drill string is tripped for another reason, such as changing the drill bit size. Examples of wireline formation testers are described, for example, in U.S. Pat. Nos. 3,934,468; 4,860,581; 4,893,505; 4,936,139; 5,622,223; 6,719,049 and 7,380,599.

To avoid or minimize the downtime associated with tripping the drill string, another technique for measuring formation properties has been developed in which tools and devices are positioned near the drill bit in a drilling system. Thus, formation measurements are made during the drilling process and the terminology generally used in the art is "MWD" (measurement-while-drilling) and/or "LWD" (logging-while-drilling). A variety of downhole MWD and LWD drilling tools are commercially available. Further, formation measurements can be made in tool strings which do not have a drill bit but which may circulate mud in the borehole.

MWD typically refers to measuring the drill bit trajectory as well as wellbore temperature and pressure, while LWD typically refers to measuring formation parameters or properties, such as resistivity, porosity, permeability, and sonic velocity, among others. Real-time data, such as the formation pressure, facilitates making decisions about drilling mud weight and composition, as well as decisions about drilling rate and weight-on-bit, during the drilling process. While LWD and MWD have different meanings to those of ordinary skill in the art, that distinction is not germane to this disclosure, and therefore this disclosure does not distinguish between the two terms.

As opposed to wireline conveyed tools, pipe conveyed logging tools traditionally record the collected downhole for retrieval when the logging tool is pulled out of the wellbore. In such circumstances, each well logging instrument is provided with a battery and memory to store the acquired data. Without any communication with the surface, surface operators cannot be certain the instruments are operating correctly and cannot modify the operation of the instruments in view of data acquired.

Recently, a type of drill pipe has been developed that includes a signal communication channel. See, for example, U.S. Pat. No. 6,641,434 issued to Boyle et al. and assigned to the assignee of the present disclosure. Such drill pipe, known as wired drill pipe, has in particular provided substantially increased signal telemetry speed for use with LWD instruments over conventional LWD signal telemetry, which typically is performed by mud pressure modulation or by very low frequency electromagnetic signal transmission.

A continuing goal of formation testers is to obtain uncontaminated fluid samples that are representative of the formation fluid in situ. According to one or more aspects of the present disclosure, an apparatus and method is disclosed for treating a contact point at the formation for obtaining a formation fluid sample.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
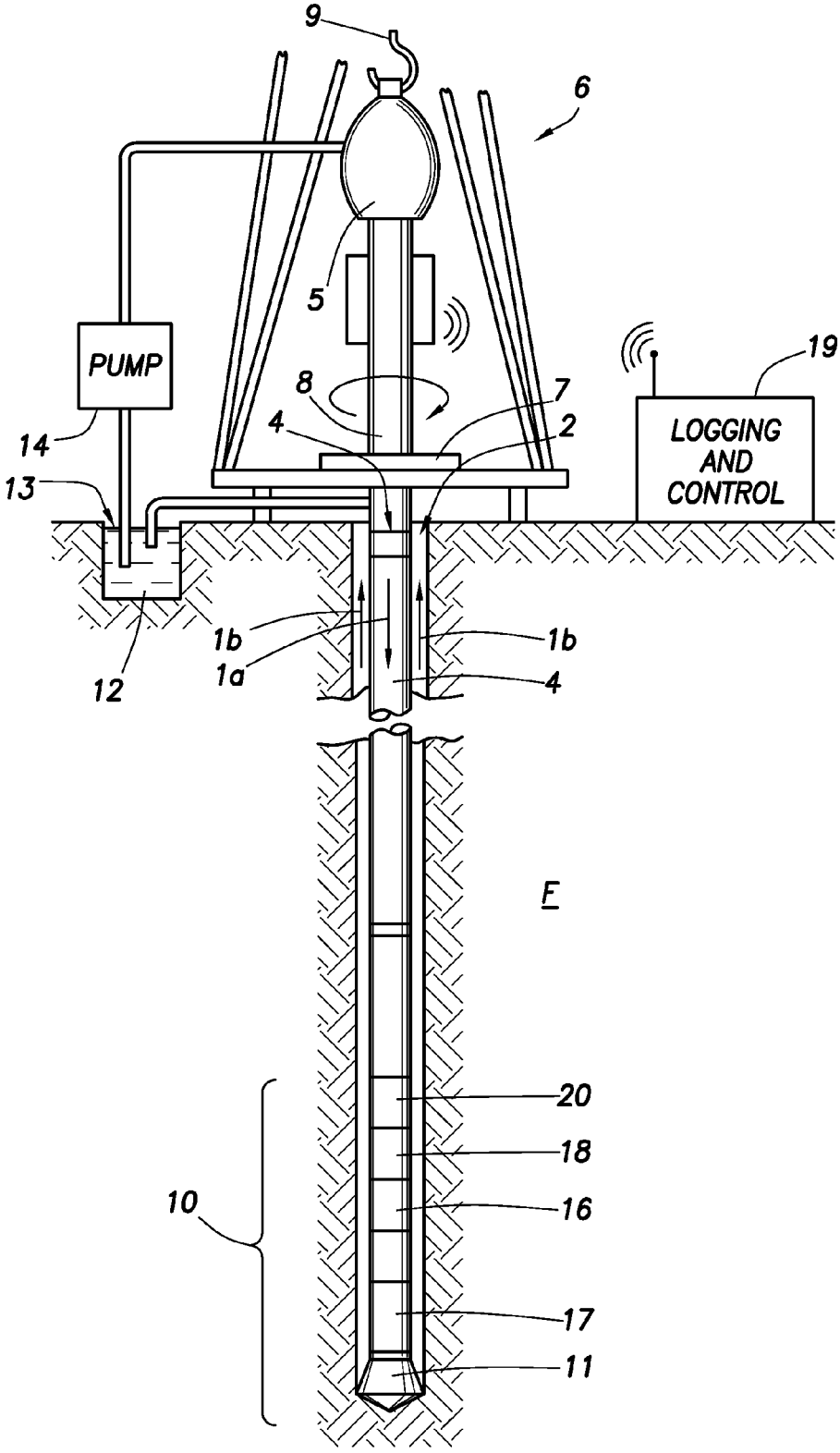
FIG. 1 is a schematic view of an apparatus according to one or more aspects of the present disclosure deployed in a wellbore on a tubular string.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The phrase "formation evaluation while drilling" refers to various sampling and testing operations that may be performed during the drilling process, such as sample collection, fluid pump out, pretests, pressure tests, fluid analysis, and resistivity tests, among others. It is noted that "formation evaluation while drilling" does not necessarily mean that the measurements are made while the drill bit is actually cutting through the formation. For example, sample collection and pump out are usually performed during brief stops in the drilling process. That is, the rotation of the drill bit is briefly stopped so that the measurements may be made. Drilling may continue once the measurements are made. Even in embodiments where measurements are only made after drilling is stopped, the measurements may still be made without having to trip the drill string. Those skilled in the art, given the benefit of this disclosure, will appreciate that the disclosed apparatuses and methods have applications in operations other than drilling and that drilling is not necessary to practice this invention.

In this disclosure, "hydraulically coupled" or "hydraulically connected" and similar terms, may be used to describe bodies that are connected in such a way that fluid pressure may be transmitted between and among the connected items. The term "in fluid communication" is used to describe bodies that are connected in such a way that fluid can flow between and among the connected items. It is noted that hydraulically coupled or connected may include certain arrangements where fluid may not flow between the items, but the fluid pressure may nonetheless be transmitted. Thus, fluid communication is a subset of hydraulically coupled.

FIG. 1 is a schematic of a well system according to one or more aspects of the present disclosure. The well can be onshore or offshore. In the depicted system, a borehole or wellbore 2 is drilled in a subsurface formation(s), generally denoted as "F". The depicted drill string 4 is suspended within wellbore 2 and includes a bottomhole assembly 10 with a drill bit 11 at its lower end. The surface system includes a deployment assembly 6, such as a platform, derrick, rig, and the like, positioned over wellbore 2. Depicted assembly 6 includes a rotary table 7, kelly 8, hook 9 and rotary swivel 5. Drill string 4 is rotated by the rotary table 7 which engages the kelly 8 at the upper end of the drill string. Drill string 4 is suspended from hook 9, attached to a traveling block (not shown), through kelly 8 and rotary swivel 5 which permits rotation of the drill string relative to the hook. As is well known, a top drive system may alternatively be used.

The surface system may further include drilling fluid 12 (e.g., mud) stored in a pit 13 or tank at the wellsite. A mud pump 14 delivers drilling fluid 12 to the interior of drill string 4 via a port in swivel 5, causing the drilling fluid to flow downwardly through drill string 4 as indicated by the directional arrow 1*a*. The drilling fluid exits drill string 4 via ports in the drill bit 11, and then circulates upward through the annulus region between the outside of the drill string and the wall of the wellbore, as indicated by the directional arrows 1*b*. In this well known manner, the drilling fluid lubricates drill bit 11 and carries formation cuttings up to the surface as it is returned to pit 13 for recirculation.

The depicted bottomhole assembly ("BHA") 10 includes a logging tool 20 (e.g., module, logging-while-drilling ("LWD")) a measuring-while-drilling ("MWD") module 16, a roto-steerable system and motor 17, and drill bit 11. According to one or more aspects of the present disclosure, logging tool 20 may be a downhole formation tester (e.g., sampling tool).

Logging tool 20 may be housed in a special type of drill collar and can contain one or a plurality of logging instruments and sampling systems. In some embodiments, logging tool 20 may be disposed (e.g., pumped) through drill string 4, for example via a wireline, instead of being incorporated in drill string 4. It will also be understood that more than one logging tool can be employed. In the depicted embodiment, logging tool 20 includes capabilities for measuring (e.g., sensors), processing, and storing information, as well as for communicating with the surface equipment.

MWD module 16 may also housed in a special type of drill collar, as is known in the art, and can contain one or more devices for measuring characteristics of the drill string and drill bit. BHA 10 may include an apparatus for generating electrical power to the downhole system. This may typically include a mud turbine generator powered by the flow of the drilling fluid, it being understood that other power and/or battery systems may be employed. The MWD module may include, for example, one or more of the following types of measuring devices: a weight-on-bit measuring device, a torque measuring device, a vibration measuring device, a shock measuring device, a stick slip measuring device, a direction measuring device, and an inclination measuring device.

BHA 10 may include an electronics module or subsurface controller (e.g., electronics, telemetry), generally denoted as 18. Subsurface controller 18 (e.g., controller) may provide a communications link for example between a controller 19 and the downhole equipment (e.g., the downhole tools, sensors, pumps, gauges, etc.). Controller 19 is an electronics and processing package that can be disposed at the surface. Electronic packages and processors for storing, receiving, sending, and/or analyzing data and signals may be provided at one or more of the modules as well.

Drill string 4, depicted in FIG. 1, is a wired pipe string which may provide one or more channels providing electronic communication for example between logging tool 20 and controller 19. Wired drill pipe is structurally similar to ordinary drill pipe (see, e.g., U.S. Pat. No. 6,174,001 issued to Enderle) and includes a cable associated with each pipe joint that serves as a signal communication channel. The cable may be any type of cable capable of transmitting data and/or signals, such as an electrically conductive wire, a coaxial cable, an optical fiber or the like. Wired drill pipe typically includes some form of signal coupling to communicate signals between adjacent pipe joints when the pipe joints are coupled end to end. See, as a non-limiting example, U.S. Pat. No. 6,641,434 issued to Boyle et al. and assigned to the assignee of the present disclosure for a description of one type of wired drill pipe having inductive couplers at adjacent pipe joints that may be used with the apparatus and systems of the present disclosure. However, the present disclosure is not limited to wired drill string 4 and can include other communication or telemetry systems, including a combination of telemetry systems, such as a combination of wired drill pipe, mud pulse telemetry, electronic pulse telemetry, acoustic telemetry or the like.

Controller 19 may be a computer-based system having a central processing unit ("CPU"). The CPU is a microprocessor based CPU operatively coupled to a memory, as well as an input device and an output device. The input device may comprise a variety of devices, such as a keyboard, mouse, voice-recognition unit, touch screen, other input devices, or combinations of such devices. The output device may comprise a visual and/or audio output device, such as a monitor having a graphical user interface. Additionally, the processing may be done on a single device or multiple devices. Controller 19 may further include transmitting and receiving capabilities for inputting or outputting signals.

The depicted BHA 10 includes steerable subsystem (e.g., roto-steerable) 17 for directional drilling. Directional drilling is the intentional deviation of the wellbore from the path it would naturally take. In other words, directional drilling is the steering of the drill string so that it travels in a desired direction. Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well. A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course. A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated wellbores into the earth may be generally classified as either "point-the-bit" systems or "push-the-bit" systems. In the point-the-bit system, the axis of rotation of the drill bit is deviated from the local axis of the bottomhole assembly in the general direction of the new hole. The hole is propagated in accordance with the customary three point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottomhole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Pat. Nos. 6,401,842; 6,394,193; 6,364,034; 6,244,361; 6,158,529; 6,092,666; and 5,113,953 all herein incorporated by reference. In the push-the-bit rotary steerable system there is usually no specially identified mechanism to deviate the bit axis from the local bottomhole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

Figure 2:
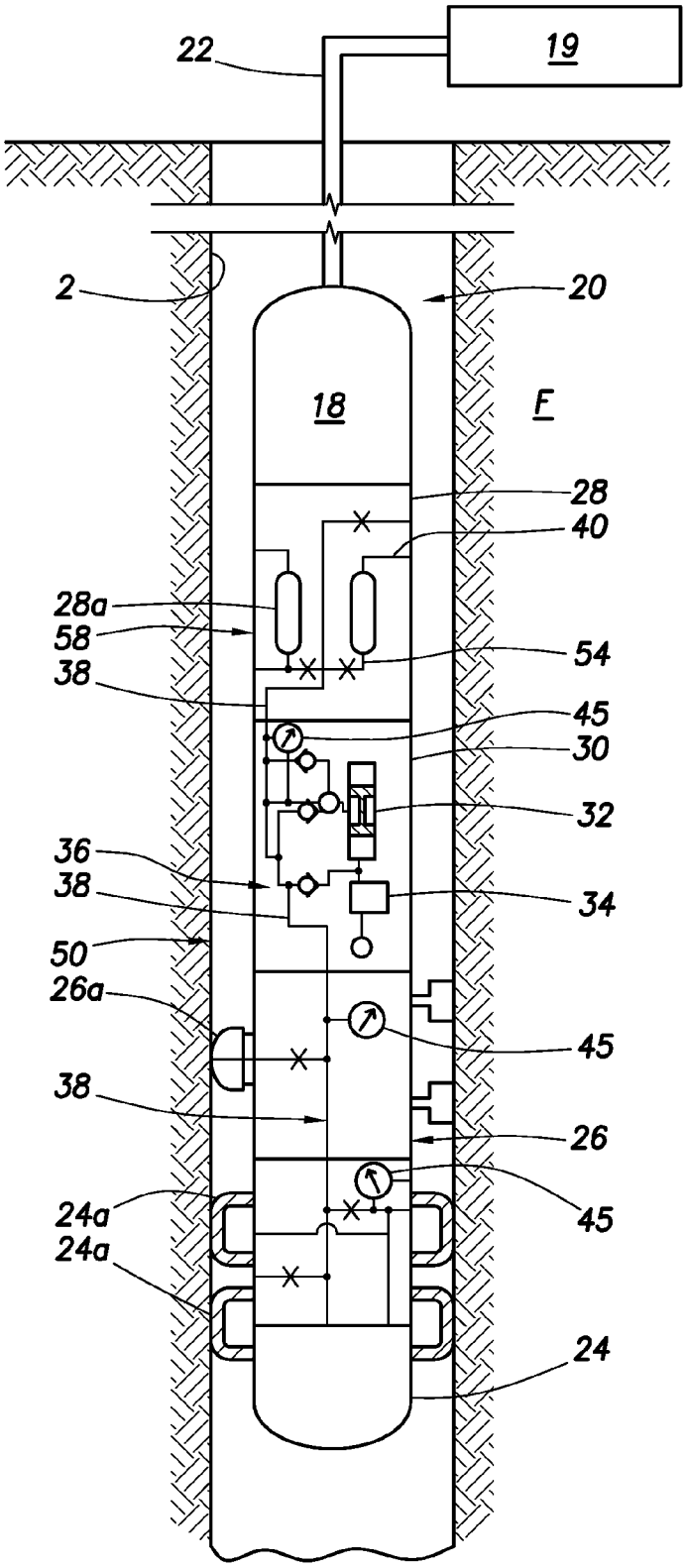
FIG. 2 is a schematic view of an apparatus according to one or more aspects of the present disclosure deployed in a wellbore on a wireline.

FIG. 2 is a schematic of a formation fluid sampling tool according to one or more aspects of the present disclosure deployed in a wellbore via a wireline. Logging tool 20, depicted as a formation fluid sampling tool in the present disclosure, is depicted lowered by a wireline 22 conveyance into wellbore 2 for the purpose of evaluating formation "F". At the surface, wireline 22 may be communicatively coupled to surface controller 19. Depicted tool 20 comprises a packer tool (e.g., module) 24, probe tool or module 26, a sample module 28, pumpout system 30 (e.g., pumpout or pump module) and may include subsurface electronics package 18 (e.g., controller).

Tool 20 includes a flowline 38 in connection with a hydraulic circuit 36 (e.g., valves, solenoids, etc.) that hydraulically couples one or more of the devices of tool 20 (e.g., sample containers 28*a*, pump 32, sensors (e.g., pressure, fluid analyzers) etc.) and formation "F" and/or wellbore 2. Examples of hydraulic circuits having one or more features applicable to the present disclosure are disclosed in U.S. Pat. Nos. 7,302,966 and 7,527,070 and U.S. Pat. Appl. Publ. No. 2006/0099093, which are incorporated herein by reference.

Depicted pumpout module 30 (e.g., pump module) includes a displacement unit ("DU") 32 (e.g., reciprocating piston pump) actuated by a power source 34 to pump fluid (e.g., wellbore fluid, formation fluid, sample fluid, treatment fluid) at least partially through tool 20. Such pumping may include, for example, drawing fluid into the tool, discharging fluid from the tool, and/or moving fluid from one location to another location within the tool (e.g., to and from sample chambers 28*a*). Examples of bi-directional displacement units (e.g., pumps) are disclosed for example in U.S. Pat. Nos. 5,303,775 and 5,337,755, which are incorporated herein by reference. Power source 34 may be, for example, a hydraulic pump or motor driving a mechanical shaft. An example of a power source including one or more hydraulic pumps is disclosed in U.S. Pat. Appl. Publ. No. 2009/0044951 which is incorporated herein by reference. An example of a power source including a motor driving a mechanical shaft is disclosed in U.S. Pat. Appl. Publ. No. 2008/0156486 which is incorporated herein by reference. Fluid may be routed to and from various devices, for example, from formation "F" and/or wellbore 2 via probe module 26 to sample module 28 and sample containers 28*a* and/or from formation "F" via probe 26*a* through the downhole fluid analyzers to sample containers 28*a*. Fluid may also be pumped "overboard" (e.g., to the wellbore) and to packer module 24 to inflate packers 24*a*. One or more sensors (e.g., gauges), generally identified by the numeral 45, may be provided to measure one or more properties or characteristics. For example, in FIG. 2 the sensors 45 are depicted as pressure and/or temperature sensors.

Figure 3:
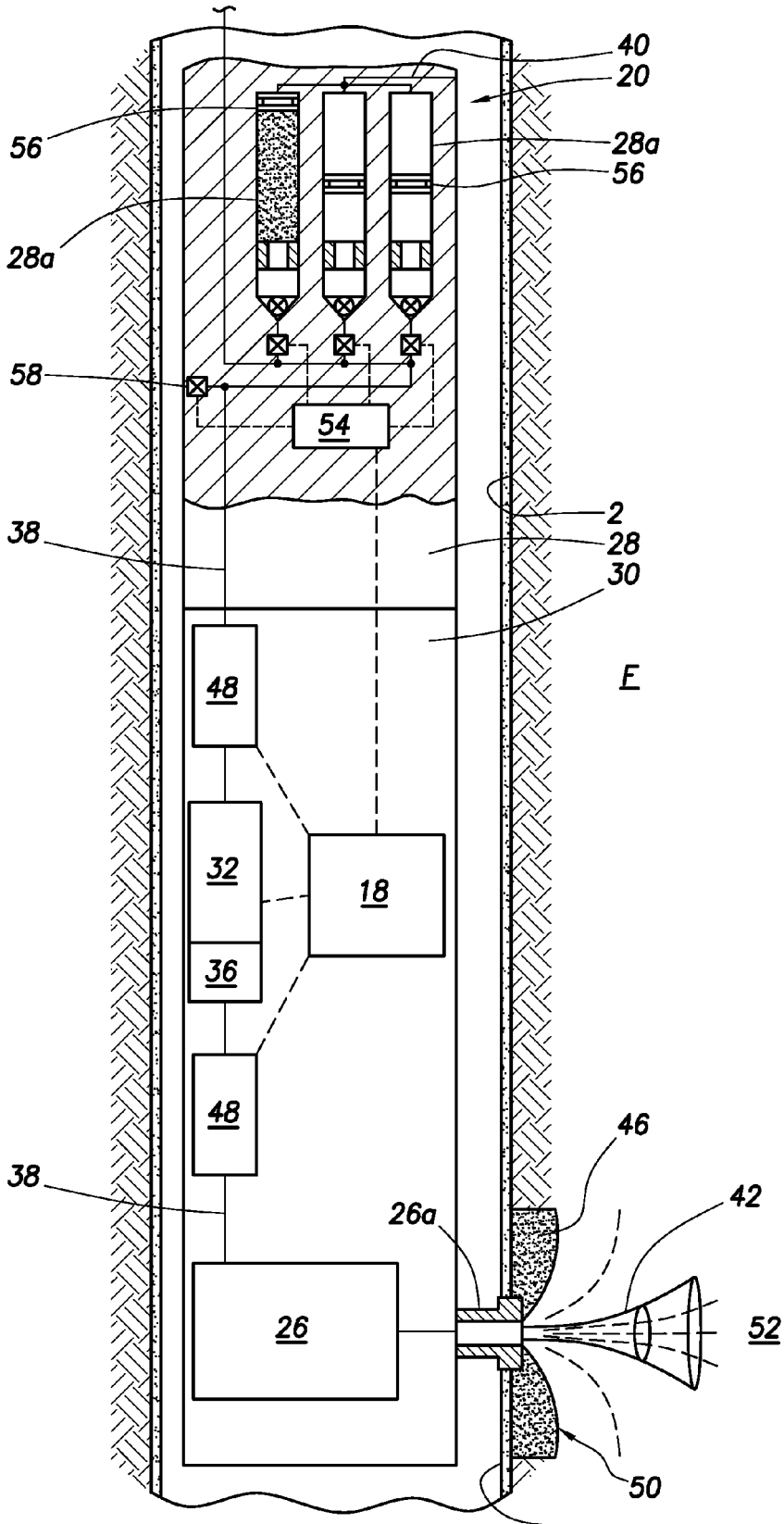
FIG. 3 is an expanded schematic view of at least a portion of an apparatus according to one or more aspects of the present disclosure.

One of the goals of formation testing is to retrieve a representative downhole formation fluid sample to the surface. Difficulties in obtaining representative formation fluid samples are due in part to a mud cake layer located at the face of the wellbore and/or the damaged zone. The damaged zone is commonly a few inches of the formation adjacent to the wellbore that comprises mechanically compacted rock (reservoir formation) and hydraulically blocked paths (e.g., pores, permeability) by mud particles (e.g., drilling fluid). Traditionally the damaged zone has been addressed by mechanical and hydraulic means. For example, a pumping action is utilized to perform a pressure measurement and/or to pump fluid from the formation into the wellbore until clean formation fluid is observed (e.g., sensor 48, FIG. 3). Formation fluid testing may be utilized while drilling, conveyed on a tubular (e.g., jointed pipe, coiled tubing) and/or via a wireline. In some instances, drilling fluid (e.g., mud) invasion into the formation may be less while drilling the wellbore than later in the life of the newly drilled wellbore when wireline testing is performed FIG. 3 is an expanded view of a formation sampling tool 20 according to one or more aspects of the present disclosure. FIG. 3 depicts displacement unit 32 and hydraulic circuit 36 adapted for pumping fluid (e.g., formation fluid, treatment fluid) through formation tester 20 via flow line 38. Multiple sample containers 28*a* are depicted in hydraulic communication via flowline 38 with wellbore 2, sensors 48 (e.g., optical fluid analyzers, etc.), probe 26*a* and displacement unit 32 and hydraulic (e.g., valve) circuit 36. In the embodiment of FIG. 3, sample containers 28*a* are also hydraulically coupled to flowline 38 via valve 54 (e.g., manifold, valve network, etc.).

Depicted sample containers 28*a* have a finite volume, for example 350 cc. "Finite" volume is utilized herein to mean that container is not in communication with another source of fluid to replenish the sample container with treatment fluid, without retrieving tool 20 from the wellbore. Sample containers 28*a* are depicted hydraulically coupled to wellbore 2, and thus the hydrostatic column, via flowline 40. According to one or more aspects of the present disclosure, the hydrostatic column of wellbore 2 may act on piston 56 to provide all or part of the force to drive the a fluid contained in the sample chamber (e.g., treatment fluid or sampled fluid) overboard (e.g., to the wellbore), for example at port 58, or out of probe 26*a*.

In the embodiment of FIG. 3, the left most sampling bottle 28*a* contains a treatment fluid 42 (e.g., acid). In the depicted embodiment, the sample container disposes approximately 350 cc of treating fluid 42. According to one or more aspects of the present disclosure, treatment fluid 42 is selected and/or adapted to react with the mud cake layer 44 and/or formation "F" (e.g., damaged zone 46) to provide improved access to formation to obtain a representative formation fluid sample. For example, and without limitation, treatment fluid 42 may comprise about 15% HCl with corrosion inhibitors and viscosity agents to facilitate pumping may be utilized. According to one or more aspects of the present disclosure, treatment fluid 42 desirable removes a portion of the mud cake layer to provide a clean contact point 50 between probe 26*a* and formation "F." Treatment fluid 42 may be adapted to improve the permeability or to otherwise treat the damaged zone 46 proximate to contact point 50 to promote the inflow of formation fluid 52 into probe 26*a* and into a one or more of sample chambers 28*a*. As will be understood by those skilled in the art with benefit of this disclosure, one or more of sample containers 28*a* may contain a treatment fluid 42. In the depicted embodiment, at least one of the sample containers 28*a* is maintained clean, e.g., it does not contain treatment fluid 42, for storing formation fluid 52. In some embodiments, a sample container 28*a* may be cleaned of residual treatment fluid 42 while disposed in wellbore 2 for storage of formation fluid 52. For example, after dispensing treatment fluid 42, hydraulic circuit 36 may be reversed and formation fluid may be pumped through a sample container 28*a* and overboard until the sample container is cleaned for storage of a formation fluid 52 sample.

FIG. 3 illustrates probe 26*a* extended into contact with formation "F" at contact point 50 in preparation for obtaining a sample of formation fluid 52. Probe 26*a* may be extended to a position adjacent to contact point 50 without being in direct contact with point 50. The hydraulic circuits (e.g., circuit 36 and/or valves 58) are actuated such that a flow path is opened between the left most sample container 28*a* and probe 26*a*. In this embodiment the flow path is provided through flowline 38 and passes through sensors 48 and displacement unit 32. However, it should be recognized that the flow path may be routed around one or more devices. In the depicted embodiment, the hydrostatic pressure acting on piston 56 is sufficient to discharge treatment fluid 42 through probe 26*a* to mud cake layer 44 and/or damaged zone 46. Displacement unit 32 may be utilized to provide pumping force to treatment fluid 42. The depth of invasion of treatment fluid 42 into formation "F" is exaggerated in FIG. 3. For example, damages zone 46 is described in the depicted embodiment as a region of formation "F" extending no more than several inches radially into formation "F" from wellbore 2.

After discharging treatment fluid 42, the hydraulic circuits may be actuated such that formation fluid 52 may flow from formation "F" into probe 26*a* and into one or more of sample containers 28*a*. Displacement unit 32 may be operated to draw formation fluid 52 into sample chamber 28*a*. One of the goals of formation testing is to obtain a sample of the formation fluid that is representative of the formation fluid in situ. Thus, a period of time may be allowed to elapse after discharging the finite volume of treatment fluid 42 before drawing a formation fluid 52 sample. The elapsed time may be provided to allow for treatment fluid 42 to react and neutralize. In some embodiments, formation fluid 52 may be allowed to flow into wellbore 2 at contact point 50 for a period of time prior to sampling so that a clean, representative sample may be obtained.

Figure 4:
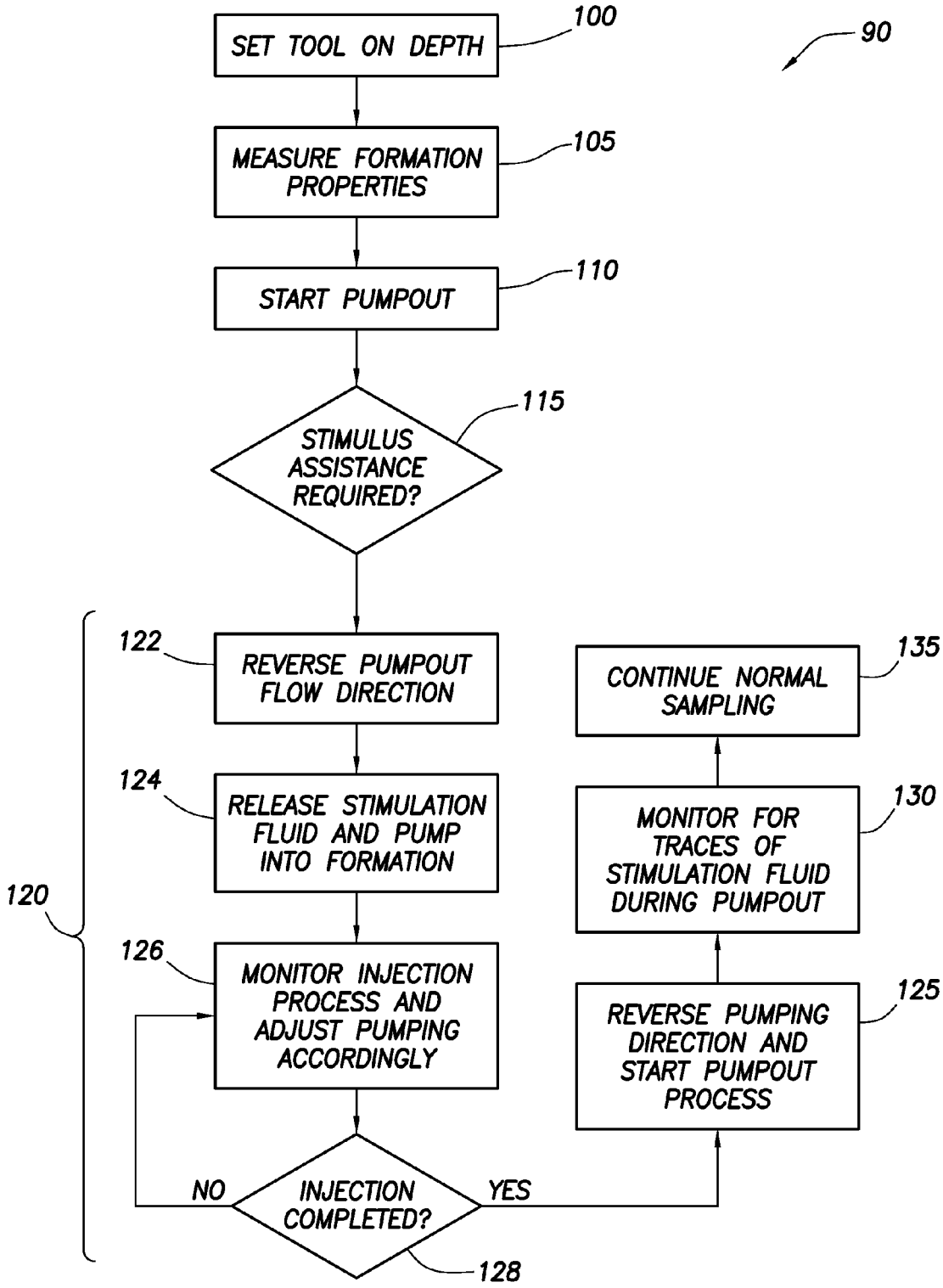
FIG. 4 is a schematic diagram of a method according to one or more aspects of the present disclosure.

FIG. 4 is a schematic diagram of a method for obtaining a formation fluid 52 sample according to one or more aspects of the present disclosure. The method 90 is described with reference to FIGS. 1-3. At step 100, tool 20 is deployed in wellbore 2 via a tubular 4 or wireline 22 to the desired position relative to formation "F". In step 105, formation properties (e.g., temperature, pressure, resistivity, etc.) may be measured via one or more logging tools conveyed with formation tester 100 and/or via sensors 45 (e.g., gauges) and/or instruments carried with tool 20. In step 110, a pumpout process may be initiated to obtain a sample of formation fluid 52. For example, probe 26*a* may be extended to a position adjacent to contact point 50 and displacement unit 32 may be actuated to draw formation fluid 52 into probe 26*a*. During pumpout 110, the sampled formation fluid may be passed through one or more of sensors 48. For example, the sampled fluid may be passed through an optical fluid analyzer 48. If the sampled formation fluid 52 appears to be uncontaminated and/or if a satisfactory volume and or flow rate of formation fluid is obtained, the formation fluid 52 may be directed into one or more empty sample chambers 28*a* for storage and retrieval to the surface or analyzed downhole and pumped overboard.

In step 115 a determination may be made as to whether the contact point 50 (e.g., mud cake layer 44 and/or damage zone 46) need to be treated, e.g., stimulated, so that a desired formation fluid 52 sample may be obtained. The decision may be made based on any number of criteria and/or subjectively determined. The decision may be made, via a processor, such controller 18 and/or controller 19, based on instructions associated with conditions and/or measured properties. For example, if no formation fluid 52 is obtained in pumpout step 110 it may be desired to treat contact point 50. If utilization of treatment 42, for example as described with reference to FIG. 3, does not provide for an inflow of formation fluid it may be determined that a formation problem other than mud cake or a damaged zone is present. Similarly, if high pressures are encountered in drawing formation fluid 52 into probe 26*a* it may be desired to perform a finite treatment to improve the productivity at contact point 50 and/or identifying an issue to be further evaluated.

Treatment step 120 may comprise multiple steps, such as steps 122, 124, 126 and 128. In step 122, hydraulic circuit 36 is reversed from first pumpout step 110 to provide fluid flow from one or more of sample containers 28*a* to probe 26*a*. In step 124, the one or more sample containers 28*a* that contain treatment fluid 28*a* are opened (e.g., valves 54) to permit treatment fluid 42 to flow through flowline 38 and probe 26*a* to contact point 50. Treatment fluid 42 may be discharged in response to the hydrostatic pressure of wellbore 2 acting on piston 56 and/or via displacement unit 32. Monitoring 126 of the discharge (e.g., injection) of treatment fluid 42 at contact point 50 may be performed in various manners. For example, monitoring pressure at one or more points in flowline 38 may indicate that the finite volume of treatment fluid 42 has been spent and/or that an obstruction at contact point 50 is limiting the desired application of treatment fluid 42. In step 128, the completion of the treatment step is determined, for example, by the depletion of the finite supply of treatment fluid 42 in sample container 28*a*.

In step 125, the pumpout process (e.g., step 110) is repeated. In step 130, the formation fluid 52 in step 125 is monitored for example via sensor 48 to determine if treatment fluid 42 is present in the formation fluid 52 sample. If treatment fluid 42 is present in the sample, the formation fluid may be pumped overboard and sampling continued until a sample without treatment fluid contamination is obtained (step 135). The clean sample of formation fluid 52 may then be pumped into a sample container 28*a* for storage or the formation fluid sample may be analyzed in the tool and pumped overboard. The sample container 28*a* utilized for sample storage may be deployed in the wellbore in a clean state or cleaned (e.g., flushed) of contamination downhole. For example, a sample chamber 28*a* that is deployed with treatment fluid 42 may be cleaned for storage of a sample of formation fluid 52. As previously, disclosed the original treatment fluid may be utilized in the treatment step or pumped overboard for use in sample storage. Prior to storing the formation fluid sample, the sample container may be flushed during a pumpout cycle.

According to one or more aspects of the present disclosure, an apparatus for obtaining a sample of a formation fluid at a downhole position in a wellbore comprises a container carrying a finite volume of a treatment fluid; a probe adapted to be positioned proximate to a contact point with the formation; a flowline in hydraulic communication between the container and the probe; and a hydraulic circuit operable to provide a fluid flow path from the container to the probe and from the probe to the container. The apparatus may comprise a displacement unit in communication with the flowline for pumping fluid from the probe to the sample chamber. The apparatus may comprise a flowline to hydraulically couple the hydrostatic pressure of the wellbore to the container to discharge the treatment fluid from the container through the probe. The apparatus may comprise a displacement unit in communication with the flowline to pump fluid from the probe to the sample chamber.

A method, according to one or more aspects of the present disclosure, for obtaining a sample of a formation fluid at a downhole position in a wellbore comprises deploying a tool into a wellbore to a downhole position adjacent to a contact point with the formation; discharging a treatment fluid from the tool to the contact point; and drawing a formation fluid sample from the formation at the contact point into the tool.

The method may comprise analyzing the formation fluid sample in the tool. The method may comprise storing the formation fluid sample in a container of the tool. The method may comprise storing the formation fluid sample in a container of the tool from which the treatment fluid was discharged. Discharging the treatment fluid may comprise applying hydrostatic pressure from the wellbore to a container of the tool storing the treatment fluid. Drawing the formation fluid sample may comprise operating a displacement unit.

According to one or more aspects of the present disclosure, deploying the tool comprises positioning a probe adjacent to the contact point; discharging the treatment fluid comprises discharging the treatment fluid from a container of the tool through the probe, the container having a finite volume; and drawing the formation fluid sample comprises operating a displacement unit and drawing the formation fluid sample into the tool through the probe.

The method may comprise flushing a container of the tool after discharging the treatment fluid from the container; and storing the formation fluid sample in the container.

A method for formation testing in a wellbore, according to one or more aspects of the present disclosure comprises deploying a formation tester to a position in a wellbore; initiating a first pumpout process to draw formation fluid from a formation at the position into the formation tester; discharging a treatment fluid from the formation tester to the formation at the position; and drawing a formation fluid sample from the formation at the position into the formation tester. Discharging the treatment fluid may comprise discharging the treatment fluid from a container of the formation tester having a finite volume. Discharging the treatment fluid may comprise discharging the treatment fluid from a container of the formation tester in response to the hydrostatic pressure of the wellbore at the position. The method may further comprise pumping the formation fluid sample into a second container of the formation tester.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method for obtaining a sample of a formation fluid at a downhole position in a wellbore, the method comprising:

deploying a tool into a wellbore to a downhole position adjacent to a contact point with a formation, the tool carrying a finite volume of treatment fluid;

discharging the treatment fluid from the tool to the contact point;

after discharging the treatment fluid, drawing a formation fluid from the formation at the contact point into the tool;

monitoring the formation fluid in the tool for the presence of the treatment fluid in the formation fluid; and continuing to draw the formation fluid into the tool until the presence of the treatment fluid is not detected in the formation fluid during the monitoring the formation fluid.

2. The method of claim 1, further comprising storing a sample of the formation fluid in a container of the tool.

3. The method of claim 1, further comprising storing a sample of the formation fluid in a container of the tool from which the finite volume of treatment fluid was discharged.

4. The method of claim 1, wherein the discharging the treatment fluid comprises applying hydrostatic pressure from the wellbore to a container of the tool storing the treatment fluid.

5. The method of claim 1, wherein:

the discharging the treatment fluid comprises operating a pump carried by the tool; and the drawing the formation fluid sample comprises operating a displacement unit.

6. The method of claim 1, wherein:

the deploying the tool comprises positioning a probe adjacent to the contact point;

the discharging the treatment fluid comprises discharging the treatment fluid from a first container of the tool through the probe, the first container having a finite volume; and the drawing the formation fluid comprises operating a pump and drawing the formation fluid into the tool through the probe.

7. The method of claim 6, further comprising storing a sample of the formation fluid in a second container of the tool.

8. The method of claim 6, further comprising:

flushing the first container after discharging the treatment fluid from the first container; and storing a sample of the formation fluid in the first container.

9. The method of claim 6, wherein the discharging the treatment fluid comprises applying hydrostatic pressure from the wellbore to the first container of the tool.

10. A method for formation testing in a wellbore, the method comprising:

deploying a formation tester to a position in a wellbore;

drawing a first formation fluid sample at the position into the formation tester through a probe;

after drawing the first formation fluid sample, discharging a treatment fluid from the formation tester through the probe and monitoring a discharge pressure for an indication of an obstruction of the treatment fluid; and subsequent to discharging the treatment fluid, drawing a second formation fluid sample into the formation tester through the probe.

11. The method of claim 10, wherein the discharging the treatment fluid comprises discharging the treatment fluid from a first container of the formation tester having a finite volume.

12. The method of claim 10, wherein the discharging the treatment fluid comprises discharging the treatment fluid from the formation tester in response to the hydrostatic pressure of the wellbore at the position; and wherein the drawing the second formation fluid sample into the formation tester comprises operating a pump.

13. The method of claim 12, further comprising pumping, in response to operating the pump, the second formation fluid sample into a second container of the formation tester.

14. The method of claim 10, wherein:

the formation tester comprises a pump; and the discharging the treatment fluid comprises operating the pump.

15. The method of claim 10, wherein the formation tester comprises a pump, and further comprising:

pumping the first formation fluid sample out of the formation tester and into the wellbore in response to operating the pump.

16. The method of claim 15, wherein the discharging the treatment fluid comprises operating the pump.

17. A method for testing a formation surrounding a wellbore, comprising:

deploying a formation tester to a position in a wellbore, the formation tester carrying a finite volume of treatment fluid;

drawing at the position a first formation fluid sample into the formation tester;

analyzing the first formation fluid sample in the formation tester;

after analyzing the first formation fluid sample, discharging at the position the treatment fluid from the formation tester;

after discharging the treatment fluid, drawing at the position a second formation fluid sample into the formation tester;

monitoring in the formation tester the second formation fluid sample for the presence of the discharged treatment fluid; and pumping the second formation fluid sample from the formation to the tester into the wellbore in response to detecting the presence of treatment fluid in the second formation fluid sample.

18. The method of claim 17, further comprising discharging the first formation fluid sample out of the formation tester into the wellbore.

19. The method of claim 17, wherein analyzing comprises analyzing the first formation fluid sample to determine whether the first formation fluid sample is uncontaminated.

* * * * *